US009369816B2

(12) United States Patent
Yoong et al.

(10) Patent No.: US 9,369,816 B2
(45) Date of Patent: Jun. 14, 2016

(54) OMNIPHOBIC PERFORATED BARRIER FOR HEARING AID TRANSDUCERS

(75) Inventors: Molly Yoong, Minneapolis, MN (US); Gerald Shamla, Maple Lake, MN (US); Wei Li Lin, Plymouth, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 13/404,496

(22) Filed: Feb. 24, 2012

(65) Prior Publication Data

US 2012/0219167 A1 Aug. 30, 2012

Related U.S. Application Data

(63) Continuation-in-part of application No. 12/980,672, filed on Dec. 29, 2010.

(60) Provisional application No. 61/291,496, filed on Dec. 31, 2009, provisional application No. 61/446,831, filed on Feb. 25, 2011, provisional application No. 61/490,378, filed on May 26, 2011.

(51) Int. Cl.
*H04R 25/00* (2006.01)

(52) U.S. Cl.
CPC ..... *H04R 25/654* (2013.01); *Y10T 29/49572* (2015.01)

(58) Field of Classification Search
CPC ..... H04R 25/654; H04R 2460/11; H04R 1/12
USPC ..... 381/312–331; 205/919; 428/142
See application file for complete search history.

(56) References Cited

U.S. PATENT DOCUMENTS 4,135,517 A 1/1979 Reale
4,879,750 A * 11/1989 Nassler ..... H04R 25/654 381/325

(Continued)

FOREIGN PATENT DOCUMENTS

EP 1432281 A2 6/2004
EP 1432285 A2 6/2004

(Continued)

OTHER PUBLICATIONS

"U.S. Appl. No. 12/138,267 , Response filed Mar. 9, 2012 to Final Office Action mailed Dec. 9, 2011", 8 pgs.

(Continued)

*Primary Examiner* — Matthew Eason
(74) *Attorney, Agent, or Firm* — Schwegman Lundberg & Woessner, P.A.

(57) ABSTRACT

Disclosed herein, among other things, are methods and apparatus for mitigating foreign material buildup for hearing assistance device components. The present subject matter includes a hearing assistance device transducer barrier device configured to resist accumulation and passage of foreign materials, the barrier device comprising a plug adapted to fit within a receiver opening. In various embodiments, the plug includes a membrane that is coated with oleophobic and hydrophobic materials, the membrane adapted to include an aperture, wherein the barrier is acoustically transparent but prevents the accumulation and passage of unwanted materials. Other barriers, such as a plug with a plurality of holes are described. In some embodiments a molded plastic plug including a plurality of holes provides the barrier.

20 Claims, 6 Drawing Sheets

(56) References Cited

U.S. PATENT DOCUMENTS

| | | | | | |
|---|---|---|---|---|---|
| 4,972,488 | A * | 11/1990 | Weiss | H04R 25/654 | 381/322 |
| 4,987,597 | A * | 1/1991 | Haertl | H04R 25/654 | 381/322 |
| 5,864,628 | A * | 1/1999 | Posen | H04R 25/654 | 381/322 |
| 6,068,911 | A | 5/2000 | Shouji et al. | | |
| 6,134,333 | A | 10/2000 | Flagler | | |
| 6,164,409 | A | 12/2000 | Berger | | |
| 6,212,283 | B1 | 4/2001 | Fletcher et al. | | |
| 6,310,961 | B1 * | 10/2001 | Oliveira | H04R 1/1016 | 181/130 |
| 6,449,373 | B2 | 9/2002 | Baker | | |
| 6,671,381 | B1 * | 12/2003 | Lux-Wellenhof | H04R 25/70 | 381/325 |
| 7,267,847 | B2 | 9/2007 | Karamuk | | |
| 7,372,973 | B2 | 5/2008 | Meier | | |
| 7,401,679 | B2 | 7/2008 | Ipsen | | |
| 7,443,992 | B2 | 10/2008 | Fideler | | |
| 7,499,561 | B2 | 3/2009 | Hanses et al. | | |
| 7,551,747 | B2 | 6/2009 | Huynh et al. | | |
| 7,751,579 | B2 * | 7/2010 | Schulein | H04R 1/12 | 181/129 |
| 7,773,764 | B2 | 8/2010 | Niederdrank | | |
| 7,983,434 | B2 * | 7/2011 | Rohrlein | H04R 25/652 | 381/322 |
| 8,416,974 | B2 | 4/2013 | Ammitzboll et al. | | |
| 8,792,665 | B2 | 7/2014 | Lin | | |
| 9,071,918 | B2 | 6/2015 | Higgins et al. | | |
| 2003/0196687 | A1 | 10/2003 | Campbell et al. | | |
| 2003/0198360 | A1 | 10/2003 | Niederdrank | | |
| 2004/0179709 | A1 | 9/2004 | Niederdraenk et al. | | |
| 2005/0018866 | A1 | 1/2005 | Schulein et al. | | |
| 2005/0141738 | A1 | 6/2005 | Karamuk | | |
| 2007/0047752 | A1 | 3/2007 | Wagner et al. | | |
| 2007/0142697 | A1 * | 6/2007 | Schneider | H04R 25/606 | 600/25 |
| 2008/0200779 | A1 | 8/2008 | Zimmerling et al. | | |
| 2008/0240479 | A1 * | 10/2008 | Linford | B05D 1/185 | 381/323 |
| 2008/0310660 | A1 | 12/2008 | Lin | | |
| 2009/0154747 | A1 * | 6/2009 | Vestergaard | H04R 25/654 | 381/325 |
| 2010/0322452 | A1 | 12/2010 | Ladabaum et al. | | |
| 2011/0182452 | A1 | 7/2011 | Lin | | |
| 2012/0237065 | A1 | 9/2012 | Higgins et al. | | |
| 2015/0016648 | A1 | 1/2015 | Kazemzadeh et al. | | |
| 2015/0271611 | A1 | 9/2015 | Higgins et al. | | |
| 2015/0382118 | A1 * | 12/2015 | Vaishya | A61N 1/36032 | 607/57 |

FOREIGN PATENT DOCUMENTS

| | | | |
|---|---|---|---|
| EP | 1458217 | A2 | 9/2004 |
| EP | 2003929 | A2 | 12/2008 |
| EP | 2003931 | A2 | 12/2008 |
| EP | 2493216 | A2 | 8/2012 |
| EP | 2501159 | A2 | 9/2012 |
| JP | 61203800 | | 9/1986 |
| WO | WO-9312626 | A1 | 6/1993 |
| WO | WO-9948328 | A1 | 9/1999 |
| WO | WO-03094574 | A1 | 11/2003 |
| WO | WO-2004104116 | A1 | 12/2004 |
| WO | WO-2007005852 | A2 | 1/2007 |
| WO | WO-2007005866 | A2 | 1/2007 |
| WO | WO-2008025355 | A1 | 3/2008 |
| WO | WO-2008080397 | A1 | 7/2008 |
| WO | WO-2008154954 | A1 | 12/2008 |
| WO | WO-0103468 | A2 | 1/2011 |

OTHER PUBLICATIONS

"U.S. Appl. No. 12/138,267, Advisory Action mailed Mar. 21, 2012", 3 pgs.
"U.S. Appl. No. 12/138,267, Final Office Action mailed Dec. 9, 2011", 16 pgs.
"U.S. Appl. No. 12/138,267, Non Final Office Action mailed Apr. 25, 2012", 16 pgs.
"U.S. Appl. No. 12/138,267, Response filed Sep. 30, 2011 to Non-Final Office Action mailed Jun. 30, 2011", 11 pgs.
"U.S. Appl. No. 12/138,267, Non Final Office Action mailed Jun. 30, 2011", 16 pgs.
"European Application Serial No. 08252008.1, Extended European Search Report mailed Dec. 6, 2010", 10 Pgs.
"European Application Serial No. 08252008.1, Office Action mailed Oct. 27, 2011", 5 pgs.
"European Application Serial No. 08252008.1, Response filed Jul. 1, 2011 to Extended European Search Report mailed Dec. 6, 2010", 6 pgs.
"European Application Serial No. 08252008.1, Response filed Feb. 28, 2012 to Office Action mailed Oct. 27, 2011", 10 pgs.
"European Application Serial No. 10252241.4, Extended Search Report Response filed Jan. 27, 2012", 11 pgs.
"European Application Serial No. 10252241.4; Search Report mailed Mar. 31, 2011", 7 Pgs.
U.S. Appl. No. 12/138,267 , Response filed Jan. 11, 2013 to Final Office Action mailed Oct. 11, 2012, 9 pgs.
U.S. Appl. No. 12/138,267 , Response filed Sep. 25, 2012 to Non Final Office Action mailed Apr. 25, 2012, 10 pgs.
U.S. Appl. No. 12/138,267, Advisory Action mailed Jan. 24, 2013, 3 pgs.
U.S. Appl. No. 12/138,267, Final Office Action mailed Oct. 11, 2012, 17 pgs.
U.S. Appl. No. 12/980,672, Final Office Action mailed Feb. 22, 2013, 21 pgs.
U.S. Appl. No. 12/980,672, Non Final Office Action mailed Sep. 28, 2012, 17 pgs.
U.S. Appl. No. 12/980,672, Response filed May 22, 2013 to Final Office Action mailed Feb. 22, 2013, 12 pgs.
U.S. Appl. No. 12/980,672, Response filed Dec. 28, 2012 to Non Final Office Action mailed Sep. 28, 2012, 11 pgs.
U.S. Appl. No. 13/408,826, Non Final Office Action mailed May 28, 2013, 10 pgs.
"U.S. Appl. No. 12/980,672, Final Office Action mailed Dec. 6, 2013", 16 pgs.
"U.S. Appl. No. 12/980,672, Non Final Office Action mailed Jul. 23, 2013", 18 pgs.
"U.S. Appl. No. 12/980,672, Response filed Nov. 22, 2013 to Non Final Office Action mailed Jul. 23, 2013", 11 pgs.
"U.S. Appl. No. 13/404,496, Response filed Dec. 30, 2013 to Final Office Action mailed Oct. 29, 2013", 8 pgs.
"U.S. Appl. No. 13/408,826 , Response filed Aug. 29, 2013 to Non Final Office Action mailed May 28, 2013", 9 pgs.
"U.S. Appl. No. 13/408,826, Advisory Action mailed Dec. 20, 2013", 2 pgs.
"U.S. Appl. No. 13/408,826, Final Office Action mailed Sep. 18, 2013", 11 pgs.
"U.S. Appl. No. 13/408,826, Response filed Nov. 18, 2013 to Final Office Action mailed Sep. 18, 2013", 9 pgs.
"European Application Serial No. 10252241.4, Examination Notification Art. 94(3) mailed Dec. 18, 2013", 6 pgs.
"U.S. Appl. No. 12/980,672, Advisory Action mailed Feb. 20, 2014", 2 pgs.
"U.S. Appl. No. 12/980,672, Notice of Allowance mailed Mar. 24, 2014", 10 pgs.
"U.S. Appl. No. 12/980,672, Response filed Feb. 6, 2014 to Final Office Action mailed Dec. 6, 2013", 9 pgs.
"U.S. Appl. No. 13/408,826, Non Final Office Action mailed Apr. 25, 2014", 11 pgs.
"European Application Serial No. 08252008.1, Summons to Attend Oral Proceedings mailed Feb. 27, 2014", 5 pgs.
"European Application Serial No. 12156939.6, Extended European Search Report mailed Feb. 11, 2014", 7 pgs.
Boersma, Paul, "Accurate Short-Term Analysis of the Fundamental Frequency and the Harmonics-to-Noise Ratio of a Sampled Sound", Institute of Phonetic Sciences, University of Amsterdam, Proceedings 17, (1993), 97-110.

(56) References Cited

OTHER PUBLICATIONS

Chou, Wen-Sheng, et al., "A binaural algorithm for space and pitch detection", 2011 IEEE International Conference on Acoustics, Speech and Signal Processing (ICASSP), (2011), 4976-4979.
Mitre, Adriano, et al., "Accurate and Efficient Fundamental Frequency Determination from Precise Partial Estimates", Proceedings of the 4th AES Brazil Conference, (2006), 113-118.
Noll, A. Michael, "Pitch Determination of Human Speech by the Harmonic Product Spectrum, the Harmonic Sum Spectrum and a Maximum Likelihood Estimate", Proceedings of the Symposium on Computer Processing in Communications, vol. XIX, Polytechnic Press: Brooklyn, New York, (1970), 779-797.
"U.S. Appl. No. 13/408,826, Response filed Jul. 22, 2014 to Non Final Office Action mailed Apr. 25, 2014", 9 pgs.
"European Application Serial No. 10252241.4, Examination Notification Art. 94(3) mailed Aug. 12, 2014", 5 pgs.
"European Application Serial No. 10252241.4, Response filed Apr. 14, 2014 to Office Action mailed Dec. 18, 2013", 9 pgs.
"U.S. Appl. No. 13/408,826, Final Office Action mailed Nov. 5, 2014", 11 pgs.
"European Application Serial No. 12156939.6, Extended Search Report Response filed Aug. 20, 2014 to Extended Search Report mailed Feb. 11, 2014", 18 pgs.
"U.S. Appl. No. 13/408,826, Advisory Action mailed Jan. 15, 2015", 3 pgs.
"U.S. Appl. No. 13/408,826, Notice of Allowance mailed Feb. 27, 2015", 8 pgs.
"U.S. Appl. No. 13/408,826, Response filed Jan. 5, 2015 to Final Office Action mailed Nov. 5, 2014", 9 pgs.
"European Application Serial No. 14176621.2, Extended European Search Report mailed Jan. 16, 2015", 6 pgs.
"U.S. Appl. No. 13/939,026, Non Final Office Action mailed Jul. 22, 2015", 14 pgs.

* cited by examiner

OMNIPHOBIC PERFORATED BARRIER FOR HEARING AID TRANSDUCERS

CROSS-REFERENCE TO OTHER APPLICATIONS

This application is a continuation-in-part (CIP) of and claims the benefit of priority under 35 USC. §120 of U.S. patent application Ser. No. 12/980,672, filed Dec. 29, 2010, entitled FOREIGN MATERIAL MITIGATION FOR HEARING ASSISTANCE DEVICE COMPONENTS, which claims the benefit of priority under 35 U.S.C. 119(e) of U.S. Provisional Patent Application Ser. No. 61/291,496, filed Dec. 31, 2009, both of which are incorporated by reference in their entirety. This application also claims the benefit of priority under 35 U.S.C. §119(e) of U.S. Provisional Patent Application Ser. No. 61/446,831, filed on Feb. 25, 2011, and U.S. Provisional Patent Application Ser. No. 61/490,378, filed on May 26, 2011, both of which are hereby incorporated by reference in their entirety.

FIELD OF THE INVENTION

The present subject matter relates generally to hearing aids, and in particular to earwax, oil, moisture, debris, and other foreign material mitigation for hearing aid components.

BACKGROUND

One of the recurring problems with any body worn device having transducers is the accumulation of material that might block the proper operation of the transducer. Hearing assistance devices which are body worn and which have one or more transducers frequently encounter an accumulation of moisture, wax or other foreign material which can occlude apertures for the transducers and cause damage to the transducers eventually. One example of a hearing assistance device is a hearing aid. Hearing aids have apertures for reception of sound which can be blocked by moisture, wax or other material. Hearing aids may use protective screens, such as a wax guard, microphone cover, or other acoustic screens which are intended to reduce the amount of unwanted substances that can reach the transducer. However, occlusion and other effects of the buildup of wax, moisture and other materials continue to be an issue with such devices.

One method of preventing foreign material entry is to insert a trap-style device which is a small cup with mesh at the bottom. One problem with the current method is that the mesh allows small amounts of material through, and the cup will become filled and require the hearing aid user to replace it.

What is needed in the art is a way to provide enhanced protection against the buildup of wax, moisture or other materials on hearing assistance devices. Such method and apparatus should not only improve the longevity of the transducers, but also provide reduced occurrences of partial or full blockage of apertures used for sound reception by hearing assistance devices. Such method and apparatus will allow less foreign material through to the receiver. Therefore, such approaches will typically not trap foreign material and typically will not need to be replaced as often as prior approaches.

SUMMARY

Disclosed herein, among other things, are methods and apparatus for mitigating foreign material buildup for hearing assistance device components. The present subject matter includes a hearing assistance device transducer barrier device configured to resist accumulation and passage of foreign materials, the barrier device comprising a plug adapted to fit within a receiver opening, wherein the barrier is acoustically transparent but prevents the accumulation and passage of unwanted materials. In various embodiments of the present subject matter, the plug includes a membrane that is coated with at least one of oleophobic and hydrophobic materials, the membrane adapted to include an aperture. In various embodiments, a rigid plug with a plurality of holes is employed. The plug may be made of the oleophobic and/or hydrophobic materials or it may be coated with them, or both.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present subject matter includes method and apparatus for preventing moisture, earwax, and other foreign materials from entering into a transducer (including, but not limited to, a microphone or receiver) of a hearing assistance device. The following examples will be provided for a hearing aid, which is only one type of hearing assistance device. It is understood however, that the disclosure is not limited to hearing aids and that the teachings provided herein can be applied to a variety of hearing assistance devices.

Different embodiments are provided in which a plug configuration with a membrane is used to protect the receiver and to reduce the effects of wax, moisture, and other unwanted substances. The present subject matter is demonstrated for hearing assistance devices, including hearing aids, including but not limited to, behind-the-ear (BTE), in-the-ear (ITE), in-the-canal (ITC), receiver-in-canal (RIC) or receiver-in-the-ear (RITE), completely-in-the-canal (CIC) type hearing aids, and deep insertion devices having a transducer, such as a receiver or microphone, whether custom fitted, standard, open fitted or occlusive fitted. The present subject matter can be used with any device having a transducer configured to be placed in or proximal the ear canal of a wearer.

Figure 1:
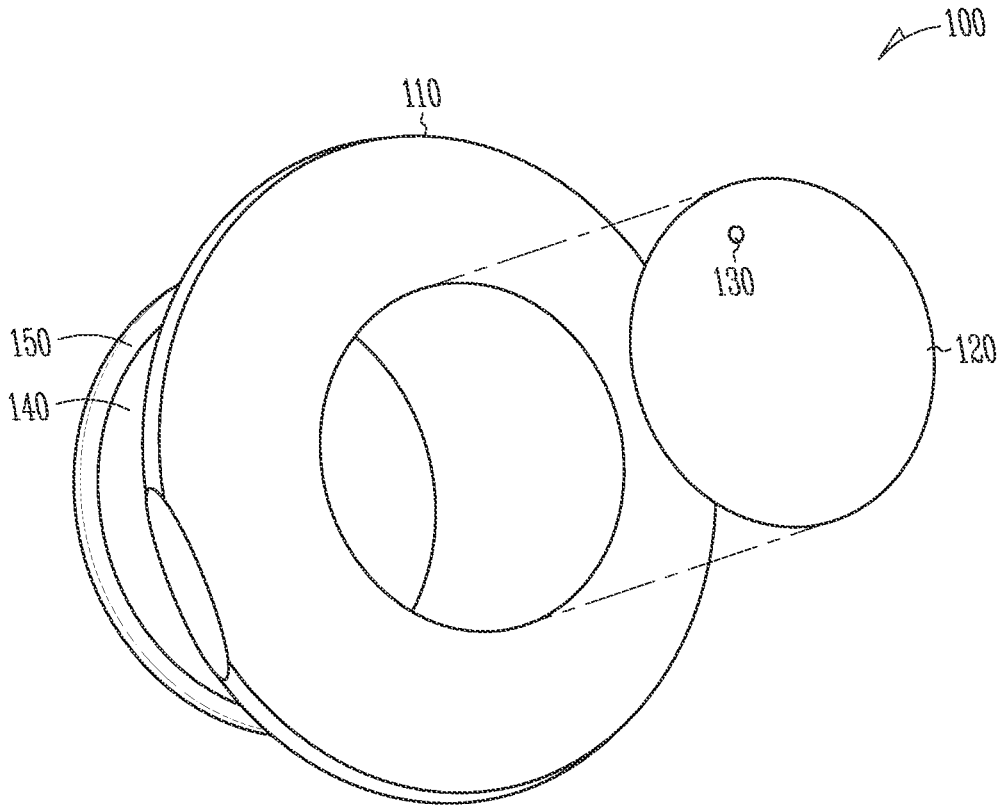
FIG. 1 is an exploded view of one example of an omniphobic perforated barrier for hearing aid transducers according to one embodiment of the present subject matter.
Figure 2:
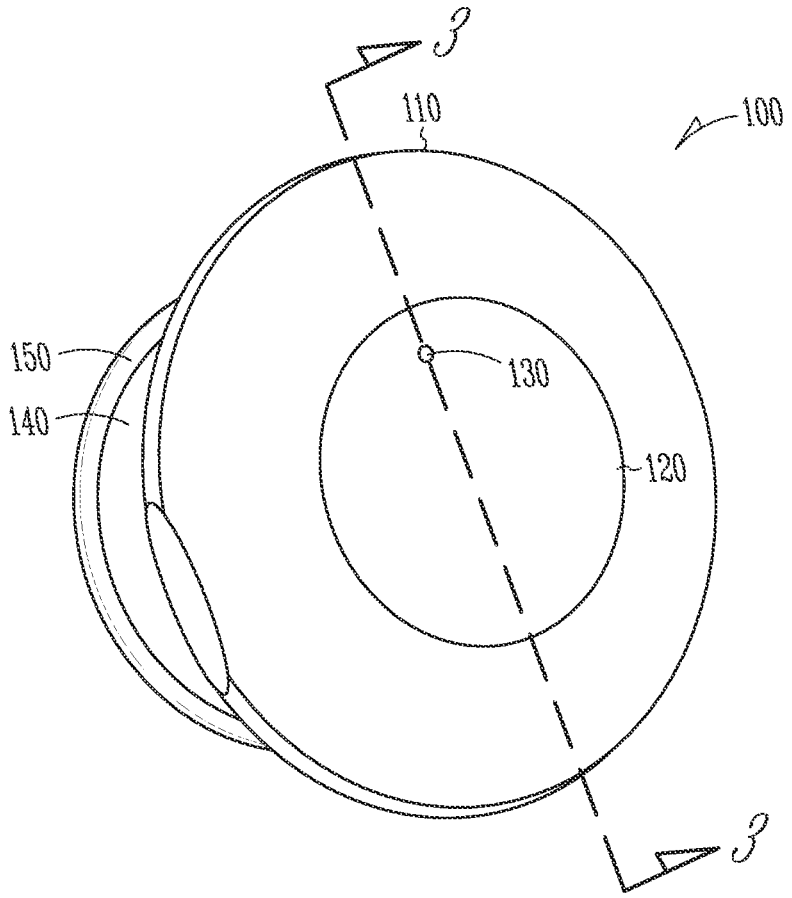
FIG. 2 is an assembled view of the barrier of FIG. 1, according to one embodiment of the present subject matter.

FIG. 1 is an exploded view of one example of an omniphobic perforated barrier 100 for hearing aid transducers according to one embodiment of the present subject matter. In this embodiment, a membrane 120 is attached to a plug 110. The membrane 120 includes an aperture 130. The aperture 130 shown in FIGS. 1-3 is circular according to one embodiment of the present subject matter. It is understood that the aperture 130 can be of a variety of shapes without departing from the scope of the present subject matter. In various embodiments, aperture 130 is configured in the shape of a circle, ellipse, oval, square, rectangular, elongate, slit, or irregular shape. Other shapes or combinations of shapes are possible without departing from the scope of the present subject matter. In various embodiments, plug 110 is formed of one or both of oleophobic and hydrophobic coatings. In various embodiments, plug 110 is coated with one or both of oleophobic and hydrophobic coatings. Plug 110 is formed of or coated with a superhydrophobic material, alone or in combination with the oleophobic and/or hydrophobic material, in various embodiments. Other types of coatings and materials can be used for the plug 110 or the membrane 120 to resist accumulation of foreign materials and passage of the foreign materials to a transducer, without departing from the scope of the present subject matter.

In various embodiments, the aperture 130 is shaped and sized to provide barometric relief, yet small enough to minimize passage of oil, wax, water, and other unwanted debris. In one embodiment the aperture 130 is circular and has a diameter of approximately 0.004 inches. Other embodiments include one or more apertures of about 0.002 to 0.008 inches.

In various embodiments, the membrane 120 is made out of an acoustically transparent polymer membrane. In various embodiments the membrane is made out of a semi-rigid microporous membrane, a microporous PTFE, a nonporous membrane, thin paper, plastics, sheet vinyl, polyethylene, Teflon PTFE films, mylar, or mylar deposited with aluminum. Membrane materials in various embodiments include linear low density polyethylene (LLDPE) blends in film form with a thickness of about 0.0003 to 0.001 inches. In various embodiments, the film is less than 0.0003 inches thick and has a diameter of 3.00 mm or less and an active compliant area of less than 2.5 mm^2 or greater. In various embodiments, the membrane has a low stiffness, high elongation, and high impact strength. In various embodiments, the membrane is a polyethylene blend including at least an organometallic complex, such as hexane or metallocene.

The membrane 120 is coated with one or both of oleophobic and hydrophobic coatings to repel earwax, oil, moisture, and other foreign objects and prevent them from sticking to the membrane. In various embodiments, the membrane 120 is coated with one or both of oleophobic and superhydrophobic materials to repel earwax, oil, moisture, and other foreign objects and prevent them from sticking to the membrane. This reduces the need for frequent replacement of the device. In various embodiments, the membrane 120 is made with oleophobic and superhydrophobic materials to repel earwax, oil, moisture, and other foreign objects and prevent them from sticking to the membrane. In various embodiments, the membrane may be made with such materials and coated with such materials.

In various embodiments, the plug 110 is made out of plastic. Other materials include, but are not limited to metal, paper, epoxy, rubber, filled or unfilled polymer, ceramic, glass, or combinations thereof. In various embodiments, the plug is produced by molding, machining, stamping, or casting. Other methods may be performed without departing from the scope of the present subject matter. In various embodiments, the plug 110 includes a cylindrical extension 140. In various embodiments, plug 110 includes a lip 150 for sealing or centering the barrier 100.

It is understood that plug 110 need not be limited to a round plug, but can be of any shape in various embodiments. It is further understood that extension 140 need not be limited to a cylindrical extension, but can be of any shape in various embodiments, including but not limited to a circle, ellipse, oval, square, rectangular, elongate, slit, or irregular shape. In addition, it is understood that lip 150 can be of any shape in various embodiments, including but not limited to a circle, ellipse, oval, square, rectangular, elongate, slit, or irregular shape. Other shapes or combinations of shapes are possible without departing from the scope of the present subject matter. For example, plug 110, extension 140 and lip 150 can all be the same shape in an embodiment. In other embodiments, two of plug 110, extension 140 and lip 150 have the same shape, with the third having a different shape. In still further embodiments, plug 110, extension 140 and lip 150 all have different shapes.

FIG. 2 is an assembled view of the barrier of FIG. 1, according to one embodiment of the present subject matter. Membrane 120 is connected to plug 110. Methods for applying the membrane 120 to plug 110 include, but are not limited to, heat staking, insert molding, overmolding, attachment by adhesives, or friction fitting. Other attachment approaches may be employed without departing from the scope of the present subject matter.

Figure 3A:
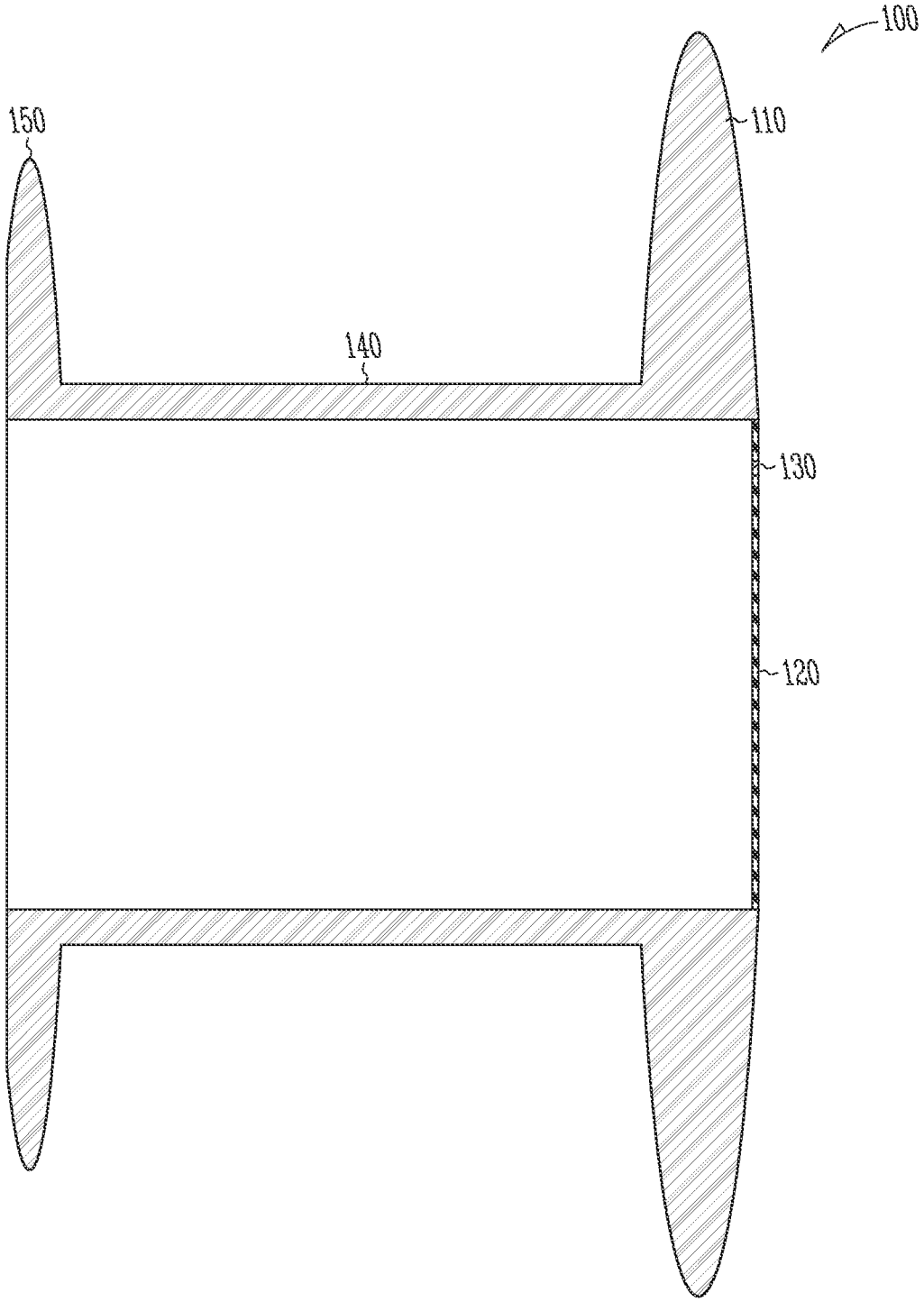
FIGS. 3A and 3B are some example variations of cross sections of the barrier of FIG. 1 along the cut line indicated in FIG. 2.
Figure 3B:
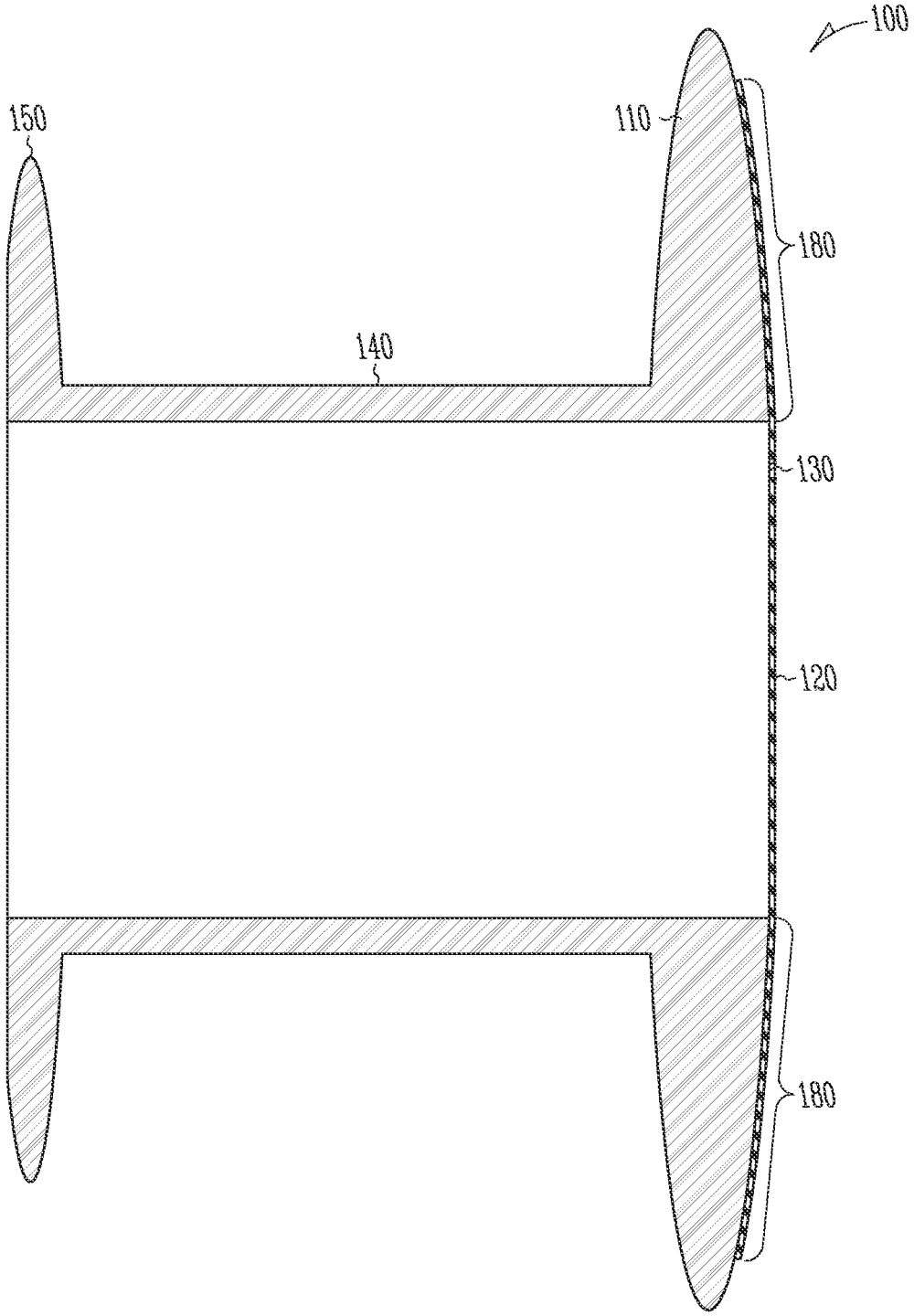

FIG. 3A is a cross section of the barrier of FIG. 1 along the cut line indicated in FIG. 2. In this embodiment, the membrane 120 matches the opening of the plug 110. FIG. 3B is a cross section of the barrier of FIG. 1 along the cut line indicated in FIG. 2. In this embodiment, the membrane 120 overlays the opening of the plug 110 (shown as overlap 180 in FIG. 3B). Other configurations of the membrane are possible without departing from the scope of the present subject matter.

Figure 5A:
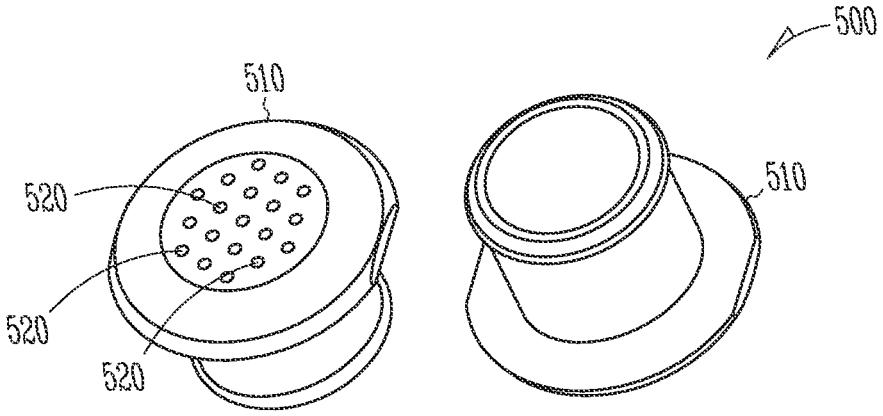
FIGS. 5A-5B are assembled views of a barrier for hearing assistance device transducers according to one embodiment of the present subject matter.
Figure 5B:
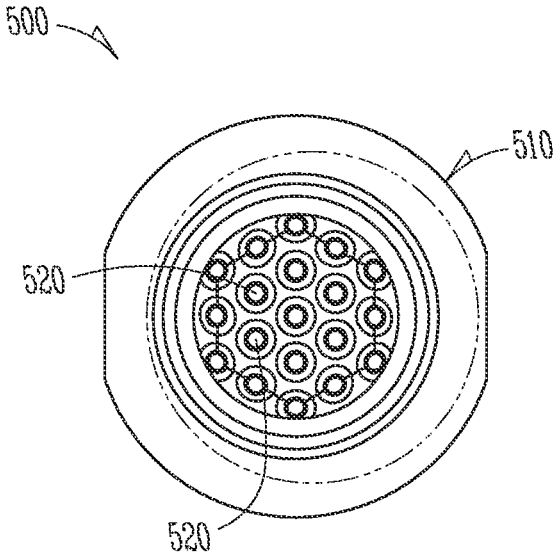

FIGS. 5A-5B illustrate one example of a barrier 500 for hearing assistance device transducers according to one embodiment of the present subject matter. Barrier 500 is a plug 510 with one or more holes 520. In various embodiments, the plug is made of a rigid material. In various embodiments, the plug is made out of plastic. In various embodiments, plug 510 is a molded plastic plug. Other manufacturing methods and materials may be employed without departing from the scope of the present subject matter. In various embodiments, holes 520 are of various shapes and sizes. In various embodiments, the holes 520 are approximately 4 mm to 5 mm in diameter. In various embodiments, the sizes and/or shapes of the holes are different among the plurality of holes in the device. In various embodiments, the sizes and/or shapes of the plurality of holes are the same among the plurality of holes in the device. Other sizes and ranges may be employed including, but not limited to 0.100 mm to 0.130 mm (or about 4 mil to about 5 mil). The holes depicted in FIGS. 5A-5B are circular in shape, however, it is understood that other shapes may be employed without departing from the scope of the present subject matter. The arrangement of holes 520 shown in FIGS. 5A-5B is exemplary and it is understood that other arrangements may be used. In various embodiments, the plug is made with hydrophobic and/or oleophobic material. In various embodiments, the plug is coated with hydrophobic and/or oleophobic material. In various embodiments, the plug is made and coated with such materials. In various embodiments, the use of holes 520 at the "top" of plug 510 enhances performance in the field over trap style designs. For example, the holes at the top portion of the plug allow a user to remove wax buildup by wiping with a cloth or tissue. This is not practical with trap style designs. Among other things, the ability to wipe wax buildup away allows for a plug design that does not need to be changed by the user as frequently as trap style designs.

Figure 4:
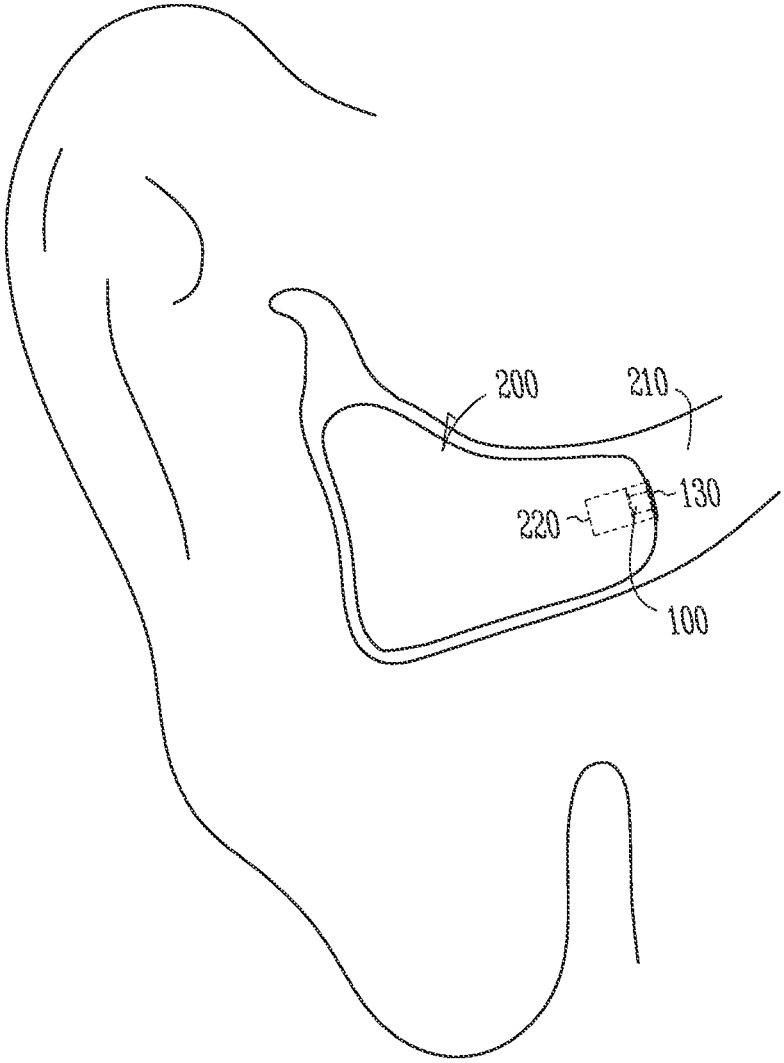
FIG. 4 shows a cross section drawing of one example of a hearing assistance device employing one embodiment of the barrier of FIG. 1.

FIG. 4 is a cross section of one example of a hearing assistance device 200 employing one embodiment of the barrier 100 of FIG. 1. Aperture 130 faces towards the ear canal 210 and protects a transducer 220 in the hearing assistance device 200. The transducer 220 may be a microphone, a receiver, or some other form of transducer. It is understood that transducer 220 may include a tube for sound transmission, such that the barrier 100 mates with the tube. Although shown as a single barrier 100, it is possible that a plurality of barriers can be employed within the teachings set forth herein. In various embodiments, the barrier 100 is designed to fit in an opening of the hearing assistance device using a friction fit. Other couplings include threads, locks, and adhesives to hold the barrier in place. Other various approaches are possible to couple the barrier to the hearing assistance device. Even though FIG. 4 shows a device located in the ear canal, it is understood that the present subject matter is not so limited, and may be used with other types of hearing assistance devices.

The present barrier prevents earwax, oils, moisture, and other foreign materials from reaching the transducer and causing damage. Therefore, this device will reduce repairs and warranty costs. Owners will not have to replace the barriers as frequently as other designs.

One aspect of the present subject matter is that in certain embodiments it provides a barrier to divert unwanted substances such as earwax, oils, moisture, and other foreign materials before entering an aperture. For example, by placing the barrier at an inlet, unwanted substances are diverted from the microphone or receiver or other device attached to or within the aperture. Thus, in certain embodiments, the present subject matter acts to divert unwanted substances as opposed to trapping them. In various embodiments the barrier is accessible for cleaning. In certain applications the barrier may be wiped clean.

Thus, several approaches and combinations of oleophobic and/or hydrophobic coatings, aperture shape, location, and sizes can be performed to migrate foreign material in such devices. The examples provided herein are not intended in an exclusive or exhaustive sense.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A barrier device configured to resist accumulation of foreign materials and passage of the foreign materials to a transducer of a hearing assistance device, the barrier device comprising:

a plug adapted to fit within an opening of a portion of the hearing assistance device, the plug comprising a semi-rigid microporous membrane having an aperture offset from a center of the membrane and the aperture configured to provide barometric relief, the membrane configured to be positioned substantially even with an external surface of the plug and coated with oleophobic and hydrophobic materials, wherein the plug includes an extension and a lip, and wherein the plug, extension and lip have different cross-sectional shapes, wherein the barrier device is acoustically transparent and prevents accumulation of the foreign materials and passage of the foreign materials to the transducer and wherein the membrane includes a polyethylene blend material configured for acoustic transparency.

2. The barrier device of claim 1, wherein the aperture is approximately 0.004 inches in diameter.

3. The barrier device of claim 1, wherein the plug is plastic.

4. The barrier device of claim 1, wherein the aperture is configured in the shape of a circle, ellipse, oval, square, rectangular, elongate, slit, or irregular shape.

5. The barrier device of claim 1, wherein the membrane includes a semi-rigid microporous membrane, a microporous PTFE, a nonporous membrane, thin paper, plastics, sheet vinyl, polyethylene, Teflon PTFE films, mylar, mylar deposited with aluminum, a linear low density polyethylene (LLDPE) blend, or a polyethylene blend including at least an organometallic complex.

6. The barrier device of claim 1, wherein the membrane is coated with a superhydrophobic material.

7. The barrier device of claim 1, wherein the plug includes a cylindrical extension.

8. The barrier device of claim 1, wherein the plug includes a lip for sealing or centering the plug.

9. A barrier device configured to resist accumulation of foreign materials and passage of the foreign materials to a transducer of a hearing assistance device, the barrier device comprising:

a plug adapted to fit within an opening of a portion of the hearing assistance device, the plug having a plurality of holes of varying shapes and sizes on a surface of the plug external to the hearing assistance device and the plug coated with oleophobic and hydrophobic materials, wherein the plug includes an extension and a lip, and wherein the plug, extension and lip have different cross-sectional shapes, wherein the barrier device includes a semi-rigid microporous material that is acoustically transparent and prevents accumulation of the foreign materials and passage of the foreign materials to the transducer and wherein the membrane includes a polyethylene blend material configured for acoustic transparency.

10. The barrier device of claim 9, wherein the plug comprises a superhydrophobic material.

11. The barrier device of claim 9, wherein the plug comprises a rigid plug.

12. The barrier device of claim 11, wherein the rigid plug is plastic.

13. The barrier device of claim 9, wherein the plug is coupled to the hearing assistance device using a friction fit, threads, locks, or adhesives.

14. A method of forming a barrier device configured to resist accumulation of foreign materials and passage of the foreign materials to a transducer, the method comprising:

forming a plug adapted to fit within an opening of a hearing assistance device, the plug comprising a semi-rigid microporous membrane having an aperture offset from a center of the membrane and the aperture configured to provide barometric relief, the membrane configured to be positioned substantially even with an external surface of the plug and coated with oleophobic and hydrophobic materials, wherein the plug includes an extension and a lip, and wherein the plug, extension and lip have different cross-sectional shapes, wherein the barrier is acoustically transparent and prevents passage of unwanted materials to the transducer and accumulation of the unwanted materials on the transducer and wherein the membrane includes a polyethylene blend material configured for acoustic transparency.

15. The method of claim 14, wherein forming the plug includes applying the membrane to the plug, wherein applying the membrane to the plug includes heat staking, insert molding, overmolding, attachment by adhesives, or friction fitting the membrane to the plug.

16. The method of claim 15, wherein applying the membrane includes applying the membrane having at least one aperture.

17. The method of claim 15, wherein applying the membrane includes applying the membrane that is coated with one or both of the oleophobic and superhydrophobic materials.

18. The method of claim 14, wherein forming the plug includes forming a rigid plug.

19. The method of claim 18, wherein forming the rigid plug includes forming the rigid plug using plastic.

20. The method of claim 14, wherein forming the plug includes forming the plug to include a cylindrical extension.

* * * * *